United States Patent [19]

Cohen et al.

[11] Patent Number: 4,839,947

[45] Date of Patent: Jun. 20, 1989

[54] CLAMP MECHANISM

[76] Inventors: Robert Cohen, 310 E. 46th St., New York, N.Y. 10017; Betty J. Charak, 343 E. 30th St., New York, N.Y. 10016

[21] Appl. No.: 219,962

[22] Filed: Jul. 14, 1988

[51] Int. Cl.[4] ..... A41F 1/00; A44B 21/00

[52] U.S. Cl. ..... 24/499; 24/557; 24/562

[58] Field of Search ..... 24/499, 498, 489, 505, 24/517, 557, 562

[56] References Cited

U.S. PATENT DOCUMENTS

| | | | |
|---|---|---|---|
| 2,433,171 | 12/1947 | Tegarty | 24/562 |
| 2,591,477 | 4/1952 | Tegarty | 24/557 |
| 2,626,439 | 1/1953 | Mack, Sr. | 24/562 |
| 3,524,226 | 8/1970 | Brown . | |
| 3,616,497 | 6/1970 | Esposito, Jr. | 24/557 |
| 3,733,656 | 5/1973 | Stalder . | |
| 3,906,957 | 9/1975 | Weston | 24/562 |
| 4,277,864 | 7/1981 | Orson, Sr. | 24/557 |
| 4,434,535 | 3/1984 | Woodley | 24/562 |
| 4,514,885 | 5/1985 | Delahousse et al. | 24/489 |
| 4,763,390 | 8/1988 | Rooz | 24/557 |

FOREIGN PATENT DOCUMENTS

| | | | |
|---|---|---|---|
| 276138 | 7/1965 | Australia . | |
| 533197 | 3/1958 | Belgium | 24/557 |
| 2042675 | 3/1972 | Fed. Rep. of Germany | 24/557 |
| 1570080 | 6/1969 | France . | |
| 2360706 | 4/1978 | France | 24/499 |

OTHER PUBLICATIONS

Page of brochure from Rainbow Badge & Trophy, date unknown (one page).

*Primary Examiner*—Victor N. Sakran
*Attorney, Agent, or Firm*—Wolder, Gross & Yavner

[57] ABSTRACT

A clamp formed of a unitary piece of resilient material has a pair of opposed arms pivoted about an integral hinge member located between jaw and finger-grip portions of the arms. An integral biasing element joins the arms at the ends of the finger-grip portion, and is supported such that flex of the biasing element occurs at its central portion, displaced from the arms. The arms may be formed with an internal spine supporting an exterior wall defining the surfaces of the arms.

5 Claims, 1 Drawing Sheet

FIG. 1
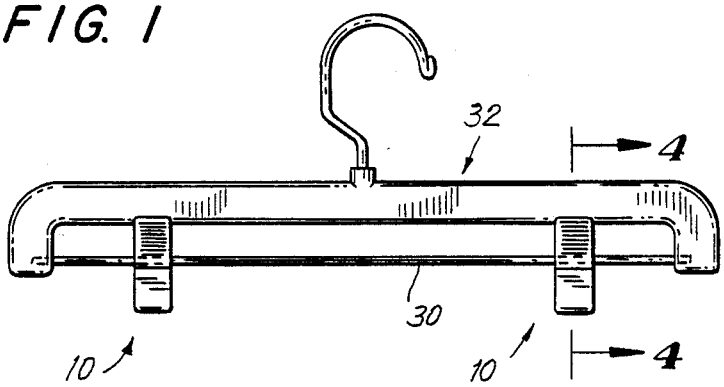
FIG. 2
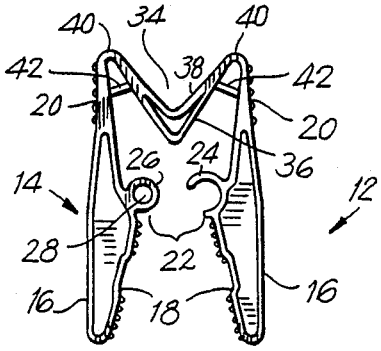
FIG. 3
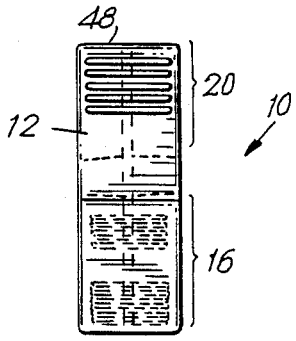
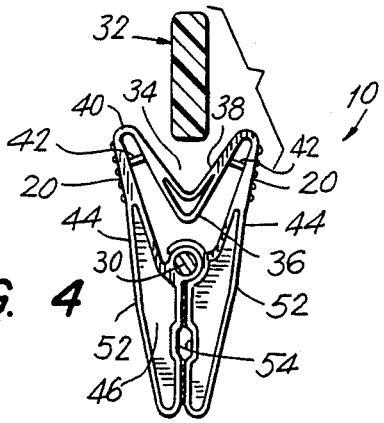
FIG. 4

CLAMP MECHANISM

The present invention relates to a new and improved clamp and, in particular, to such a clamp which is advantageously manufactured out of a unitary piece of material, typically a synthetic plastic, and which has significant usefullness in connection with the mounting of clothes items to clothes hangers and the like.

Clamping devices, formed from a variety of materials and embodying numerous constructions, are well-known. A conventional clamp such as the type utilized to support an article of clothing from a clothes hanger or similar device normally includes a pair of independent arms joined together by a pivot piece and biased in the item-clamping configuration by a spring mechanism. Because the various elements constituting the clamp are formed from individual members, both cost and effort are required to assemble the individual pieces into a completed unit.

The prior art further discloses clamps which, in an effort to overcome such problems, employ a one-piece construction. Typical of such constructions is the clothes-peg clamp disclosed in U.S. Pat. No. 3,733,656 of May 22, 1973 to F. Stalder. With a one-piece construction assembly problems are minimized. Yet other shortcomings, such as a lack of grip-strength and undesirable flex to portions of the clamp, are typically present in such constructions.

It is accordingly the purpose of the present invention to provide a one-piece clamp mechanism which exhibits both significant grip-strength while providing structural rigidity.

In accordance with the invention, a clamp is formed from an appropriate material, such as a resilient plastic resin, and includes a pair of arms having both a finger-grip portion and a jaw portion. Integral hinge means are located on each arm between the jaw and finger-grip portions, and interfit to allow pivoting of the arms. Integral bias means are provided between the finger-grip portions to bias the grip-portions of the arm together.

The bias means is connected to the arms in a manner that restricts the flex of the bias means to a portion thereof displaced from the arms, thus isolating the flexed portion from the arms and preventing the finger-grip portions from distorting. In addition, the arms may be formed with an integral strengthening rib or spine to further prevent distortion of the arms under load.

A fuller understanding of the present invention may be realized upon consideration of the following detailed description of a prefered, but nonetheless illustrative embodiment of the present invention when taken in conjunction with the annexed drawings, wherein:

FIG. 1 is a side elevation view depicting a pair of the clamps of the present invention installed upon a typical clothese hanger;

FIG. 2 is an end elevation view of the clamp depicted in the form in which it is removed from the manufacturing mold;

FIG. 3 is an enlarged side elevation view of the clamp; and

FIG. 4 is an end elevation view, in section, taken along line 4—4 of FIG. 1, depicting the clamp in its operative configuration as mounted on a hanger.

With reference to the Figures, clamp 10 is preferably molded of a unitary piece of an appropriate material, such as a plastic resin, and includes a pair of opposed and attached arms 12, 14 each having a jaw portion 16 formed with an inwardly-directed face 16 adapted to engage an item placed therebetween. The arms 12, 14 each also include a finger-grip portion 20 adapted to receive finger-pressure to separate the jaw portions.

As integral hinge means 22, is located at the intersection of the jaw and finger-grip portions and includes a semi-circular cylindrical bearing element 24 mounted to first arm 12 and circular cylindrical axle element 26 mounted to second arm 14. The inner radius of bearing element 24 and the outer radius of axle element 26 are chosen to be complimentary, such that axle element 26 can ride within bearing element 24 and rotate therein to provide hinge action between the arms. The arc of bearing element 24 is in the range of 225 degrees and is chosen to be greater than 180 degrees such that axle element 26 may be captured therein, while allowing a sufficient degree of rotational freedom between its opposed ends to allow the clamp arms to be spread without engagement of the bearing element with the points of affixation of axle element 26 to arm 14. Axle element 26 may be provided with through-bore 28 sized to accept wire rod 30 of a hanger 32, to allow the clamp to be inserted and supported therein.

Arms 12 and 14 are joined together at the distal ends 40 of finger-grip portions 20, by integral biasing means 34, which may comprise inner and out V-shaped strip-like portions 36, 38 respectively, the ends of which are joined together and to the arms 12, 14 at the arm ends 40. Integral spacers 42 support and maintain the central portion of bias means 34 away from the finger-grip portions 20 and confine the flex of the bias means to the central portion.

As best seen in FIG. 2, the clamp 10 is advantageously molded in a configuration such that the arms 12, 14 are maintained in a generally parallel configuration by bias means 34. As seen in FIG. 4, upon engagement of axle element 26 with bearing element 24, which may be accomplished by a snapping of the elements together due to the inherent flexability of the plastic material, bias means 34 exerts a pair of outwardly-directed forces upon ends 40 of finger-grip portions 20, thus pivoting jaw sectoins 16 together about hinge means 22 to grip an item inserted between the jaws. THe finger-grip portions may be squeezed together by finger pressure, overcoming the bias action, to open the jaws for item insertion or removal.

Each of the clamp arms 12, 14 may be formed with a continuous outer wall surface 44 defining both the outer faces and inner faces 48 of the jaw portions 16, as well as the outer and inner faces of the finger-grip portions 20. Interior spine 46 separates the outer and inner faces as required and provides rigidity to the arms to permit operation of the clamp without undesired flex of the arms. Both the inner faces 18 of jaw portions 16 and the outer faces of finger-grip portions 20 may be provided with appropriate transverse ridges or projections 48 to enhance the grip thereof.

It may be appreciated that the clamp of the present invention may be formed in various configurations. For example, in addition to the embodiment in which the clamp is to ride on the hanger rod 30, the clamp may be formed as an integral part of the hanger or may be formed with a solid, rather than a hollow axle element 26 where mounting of the clamp on a rod is not needed. Other modifications and adaptations may similarly be made without departing from the scope of the invention as claimed.

We claim:

1. A clamp formed of a unitary piece of resilient material comprising first and second arms, each of said arms having a jaw portion terminating at a first arm end joined to a finger-grip portion terminating at a second arm end, said jaw portions each including an inwardly-directed face adapted to jointly engage an object sought to be gripped between said jaw portions, an integral hinge member located on said arms between said finger-grip and jaw portions and comprising a first hinge member element on said first arm and a second hinge member element on said second arm, said first and second elements being engageable together to form a pivot point about which said arms rotate, and an integral biasing member extending between said finger-grip portion and affixed to said arms at the second ends thereof and having a pair of spacer members located between said biasing member and said finger-grip portion inwardly of said affixation points, whereby the biasing action is confined to the portion of said biasing member between said spacer members, the jaw ends of said arms being biased together about said hinge member by said biasing member.

2. The clamp of claim 1, wherein said biasing member comprises first and second generally V-shaped strip-like spring elements joined to each other at the ends thereof, said ends being located adjacent said affixation points.

3. The clamp of claim 2, wherein said arms are each formed at least partially by a continuous outer wall and supporting an interior spine spanning the area within said wall.

4. The clamp of claim 3, wherein said interior spine is located in the jaw portion of said arm.

5. The clamp of claim 4, wherein said interior spine is further located in at least a portion of said finger-grip portion of said arm.

* * * * *